US010376773B2

(12) United States Patent
Chung et al.

(10) Patent No.: US 10,376,773 B2
(45) Date of Patent: Aug. 13, 2019

(54) WHEEL-BEARING TRUCK

(76) Inventors: Rasyad Chung, Berkeley, CA (US); Stephen F. Sporer, Berkeley, CA (US)

( * ) Notice: Subject to any disclaimer, the term of this patent is extended or adjusted under 35 U.S.C. 154(b) by 0 days.

(21) Appl. No.: 11/043,106

(22) Filed: Jan. 27, 2005

(65) Prior Publication Data

US 2005/0167938 A1 Aug. 4, 2005

Related U.S. Application Data

(60) Provisional application No. 60/539,581, filed on Jan. 29, 2004.

(51) Int. Cl.
*A63C 17/01* (2006.01)

(52) U.S. Cl.
CPC ..... *A63C 17/012* (2013.01); *A63C 17/01* (2013.01)

(58) Field of Classification Search
CPC ..... A63C 17/012; A63C 17/01
USPC ..... 280/11.27, 11.28, 87.01, 87.021, 87.03, 280/87.041, 87.042, 87.043, 86, 86.1, 842
See application file for complete search history.

(56) References Cited

U.S. PATENT DOCUMENTS 4,089,536 A * 5/1978 Larrucea ..... A63C 17/01 280/11.28
5,048,632 A * 9/1991 Battel ..... A63C 5/08 180/181
5,263,725 A * 11/1993 Gesmer ..... A63C 17/0093 280/11.28
5,551,713 A * 9/1996 Alexander ..... A63C 17/0046 280/11.19
5,868,408 A * 2/1999 Miller ..... A63C 17/0046 280/11.28
6,224,076 B1 * 5/2001 Kent ..... A63C 17/0046 280/11.28
6,286,843 B1 * 9/2001 Lin ..... A63C 17/0066 280/11.28
6,299,186 B1 * 10/2001 Kao ..... B62K 3/002 280/11.28
6,382,646 B1 * 5/2002 Shaw ..... B62K 3/002 280/11.28

* cited by examiner

*Primary Examiner* — John D Walters
(74) *Attorney, Agent, or Firm* — Adams Law Office; Sharon Adams

(57) ABSTRACT

A wheel-bearing truck as might be used on a skateboard includes a base, a transverse hanger mounted pivotally at or near its center to the base and adapted to bear a road-engaging wheel at each opposed end. There is a pair of telescopic arms, one end of each being attached to the hanger flanking its center. A longitudinal spring fixed with respect to the base interacts with the other end of each telescopic arm.

3 Claims, 6 Drawing Sheets

WHEEL-BEARING TRUCK

BACKGROUND OF THE INVENTION

The present invention relates to wheel-bearing trucks. More particularly, although not exclusively, the invention relates to a wheel-bearing truck for mounting on a skateboard. The invention might also have application with kickboards, or any vehicle that has a rigid rear transverse swing arm or hanger that is pivoted at or near its centre to enable the vehicle to roll, and at each opposed end of which there is a road wheel mounted on bearings. Such vehicles might be non-motorised or motorised. Any kind of vehicle, cycle or motorcycle having a rear truck mounted on a swing arm of some kind might also benefit from the invention. Additionally, the invention might be applicable to multi-axle suspensions for off-road vehicles.

Skateboard trucks are known to take on different configurations in order to control performance characteristics of steering, dampening, spring rate, traction, stability, and range of motion. Traditional approaches generally compromised one set of performance characteristics for another. For example, bushing based trucks can be adjusted for quick steering portability, but not both at the same time. Such design compromises are partly a function of specialised use requirements but in other cases a function of poor design and primitive manufacturing process.

If the user desires to adjust the return-to-centre bias of modern skateboard trucks, the spring force can be adjusted only by replacing return springs with springs of different spring constant. This can be a costly and time-consuming process, especially where fine tuning is desired.

OBJECTS OF THE INVENTION

It is an object of the present invention to overcome or substantially ameliorate at least one of the above disadvantages and/or more generally to provide an improved wheel-bearing truck.

DISCLOSURE OF THE INVENTION

There is disclosed herein a truck comprising:

a base, a transverse hanger mounted pivotally at or near its centre to the base and adapted to bear a road-engaging wheel at each opposed end thereof, a pair of telescopic arms, one end of each arm attached to the hanger flanking its centre, and a longitudinal spring fixed with respect to the base and interacting with the other end of each telescopic arm.

Preferably, the truck further comprises a longitudinal track attached to or formed integrally with the base, and a slider riding along the track and to which said other ends of the arms are attached.

Preferably, the spring is a compression coil spring, and the truck further comprises a preload bolt passing through the coil spring and having one end attached to the spring preload nut and its other end attached to the base.

Preferably, the truck further comprises a spring sleeve in which the spring is housed, the spring sleeve being affixed to the slider and locating a preload nut with which the preload bolt engages.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
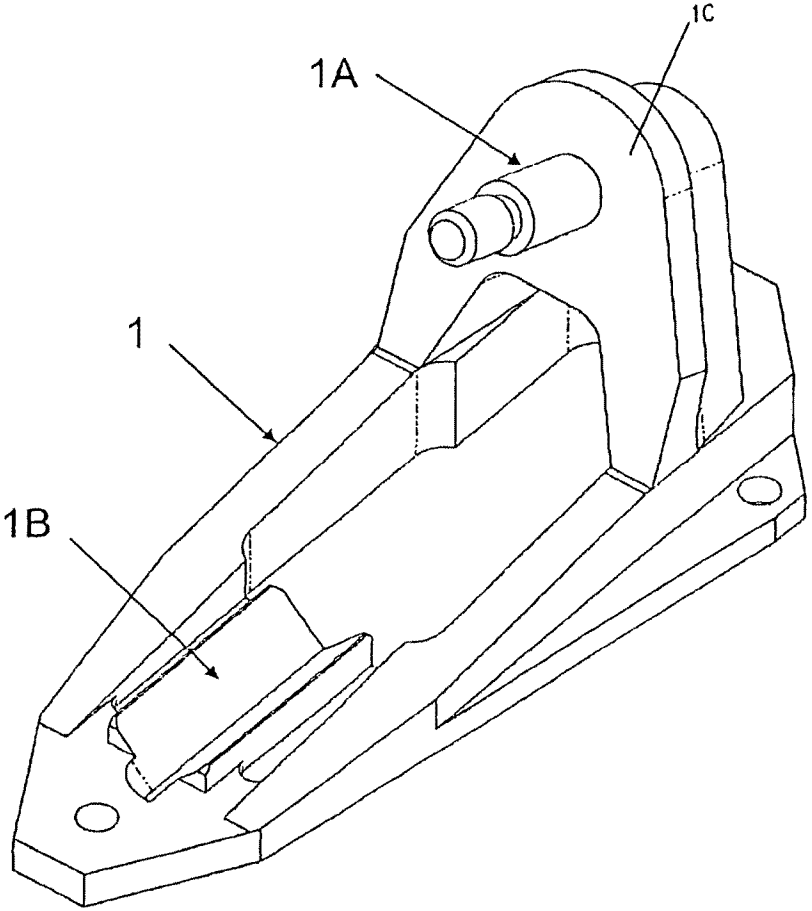
FIG. 1 is a schematic perspective illustration of a skateboard truck base.

In FIG. 1 of the accompanying drawings there is depicted schematically the base 1 of a skateboard rear truck. The base 1 is typically of cast and subsequently machined alloy and comprises a hanger pivot pin 1A projecting normally from a flat bearing surface 1C. The base also includes a longitudinal V-shaped guide 1B. There is an angular offset between the longitudinal axis of the hanger pivot and the longitudinal guide as evident in the figure. A number of mounting holes are provided in the base to enable it to be bolted to a skateboard deck.

Figure 2:
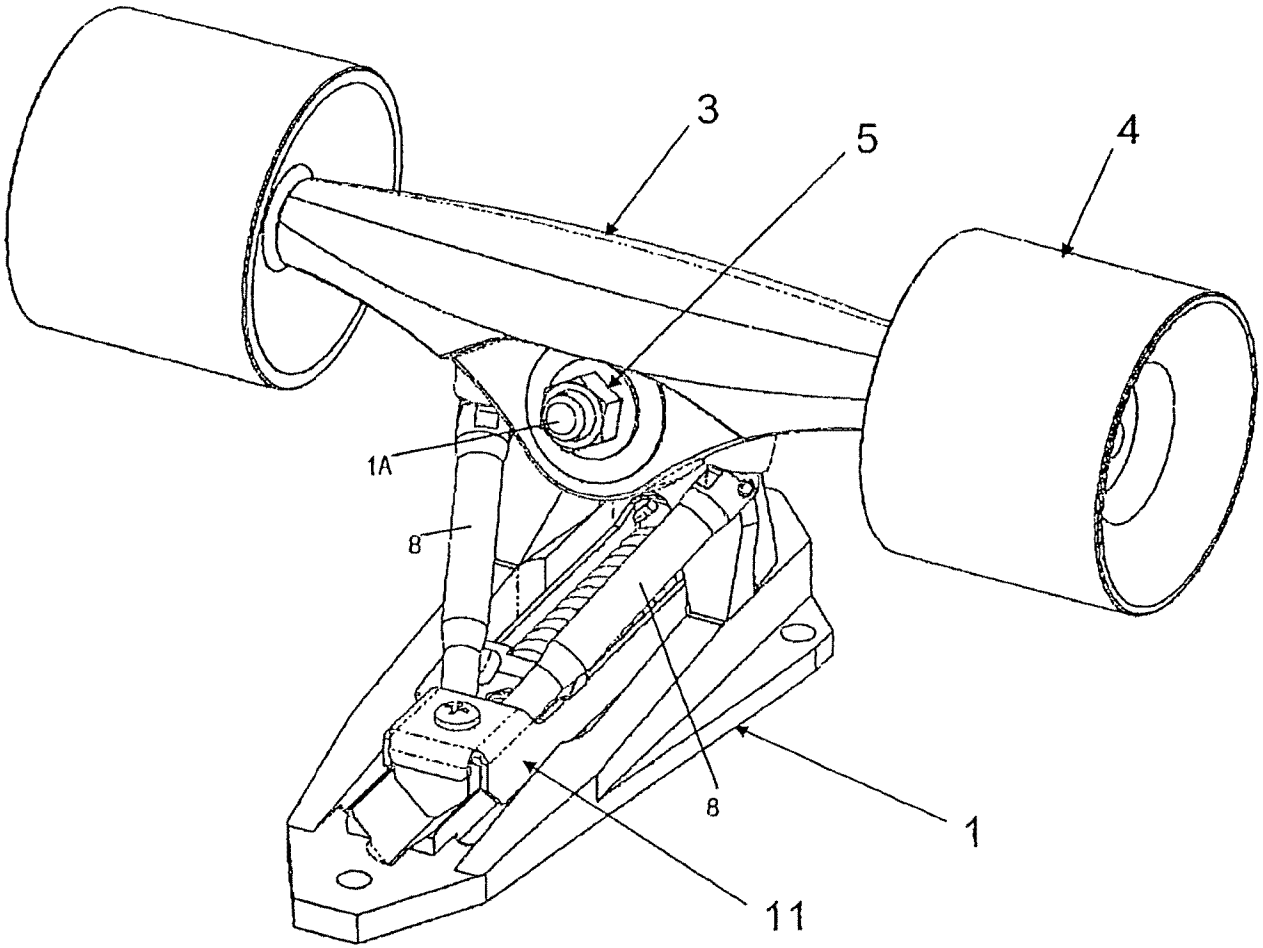
FIG. 2 is a schematic perspective illustration of a skateboard truck including the same base as depicted in FIG. 1—there being no deflection of the hanger.
Figure 3:
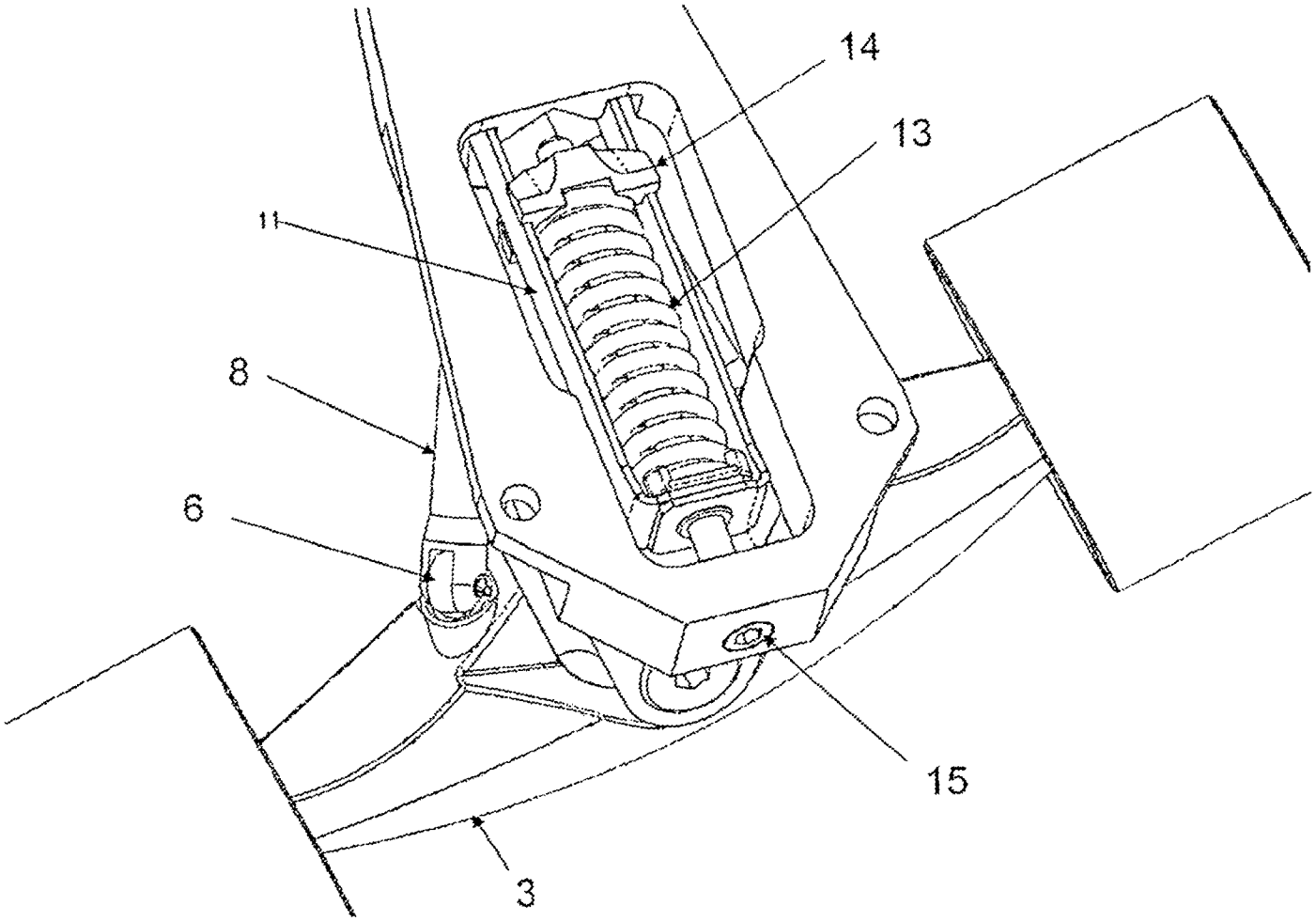
FIG. 3 is a schematic top perspective illustrations of the skateboard truck of FIG. 2—there being 20 degrees deflection of the hanger.
Figure 4:
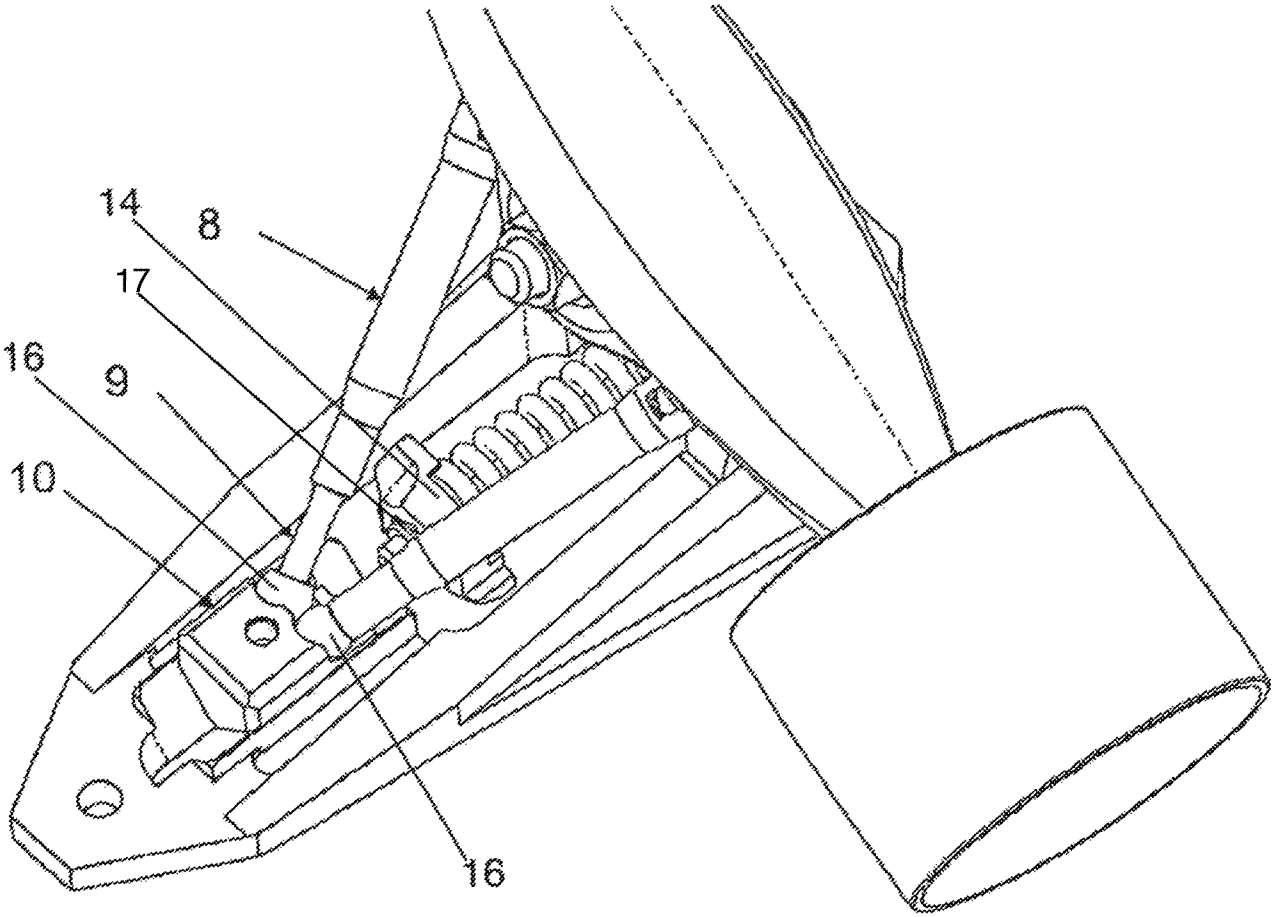
FIG. 4 is a schematic perspective illustration of the skateboard truck with its spring sleeve omitted for clarity—there being 20 degrees deflection in the truck and a 0.39 inch forward movement of the slider.
Figure 5:
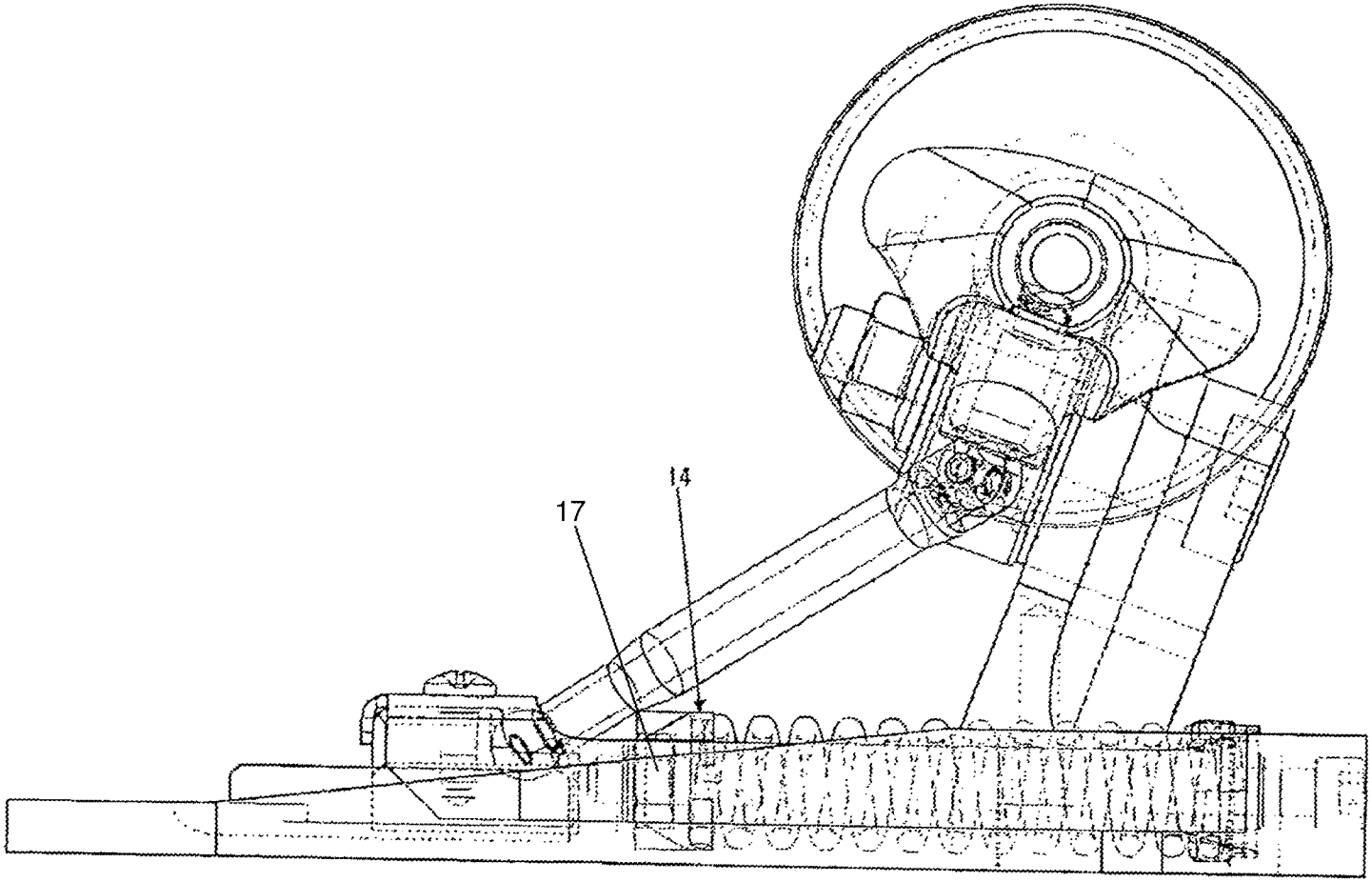
FIG. 5 is a schematic side elevation of the skateboard truck—there being no deflection in the truck, but a 0.25 inch preload.

In FIG. 2 to 4 the truck is shown assembled including a transverse extending hanger 3 having a pair of wheels 4—one at either end. The wheels would typically be mounted on roller bearings. A flange nut and washer 5 secures a mid-point of the hanger 3 to the hanger pivot 1A. The hanger 3 pivots about the hanger pivot 1A as the skateboard deck is tilted in use (a rolling movement).

A slider 10 (FIG. 4) fits upon and moves along the longitudinal guide 1B.

A pair of telescopic arms or pushrods, each telescopic arm comprising a hanger end portion 8 and a slider end portion 9 that is capable of sliding within the hanger end portion 8. Each telescopic arm extends from ball joints 16 at the slider 10 to the hanger 3. Each hanger end portion 8 is attached pivotally to the hanger 3 so that the attachment points flank the hanger pivot 1A.

A spring sleeve 11 is screw-fixed to the slider 10 and fits around the guide 1B to maintain contact between the slider 10 and the guide 1B. The spring sleeve 11 houses a compression coil spring 13 through which there extends a preload bolt 15. The preload bolt 15 is thread-engaged with a preload nut 14 with a hex nut insert 17. The preloaded bolt 15 has a hex socket head. Rotation of the preload bolt will compress the spring 13 within the spring sleeve 11. As the spring sleeve 11 is connected to the slider 10, the slider will move toward the hanger thereby contracting each of the arms.

Figure 6A:
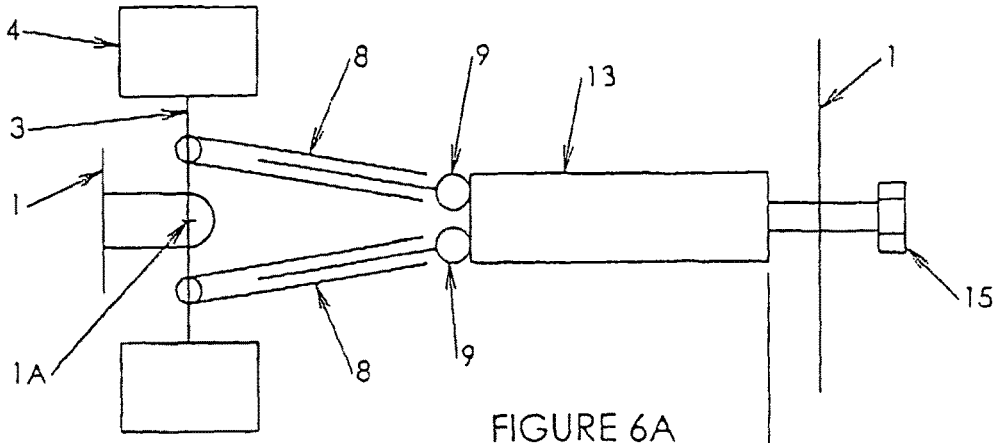
FIGS. 6A, 6B and 6C are schematic illustrations of the skateboard truck in various use configurations.

In FIGS. 6A, B and C, various preload conditions are depicted. In FIG. 6A, there is no preload in the spring 13 and the hanger 3 can pivot freely about the hanger pivot 1A throughout a limited range. The telescopic arms are neither fully compressed nor fully extended in this configuration. However, when one of the telescopic arms (depending on the turning direction) reaches its minimum length, it contacts and begins to compress spring 13 because that arm can compress no further.

Figure 6B:
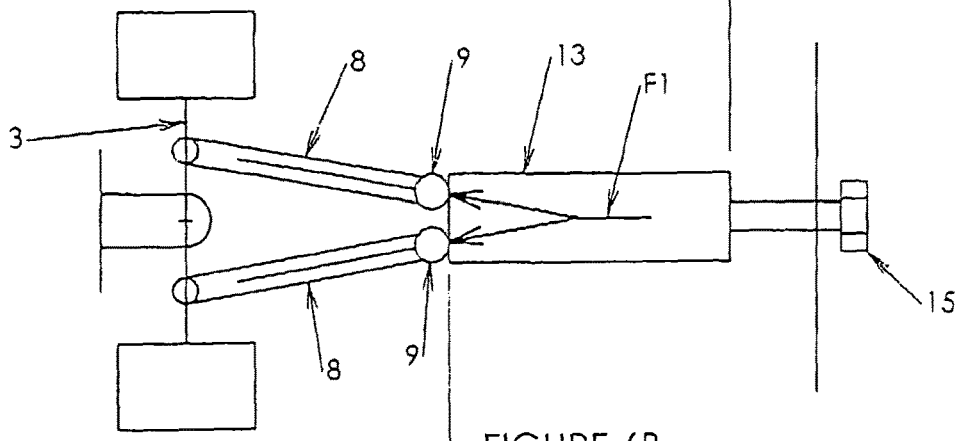

In FIG. 6B, the spring 13 is in a variable preload configuration as a result of variable turning of the preload bolt 15. As a result, force F1 is divided equally between both of the telescopic arms thus eliminating free-play between base 1, preload bolt 15, spring 13, both telescopic arms (9 and 8) and hanger 3 so that the hanger 3 is preloaded. In this configuration, the spring provides adjustable initial resistance against any angular deflection of the hanger 3 about the hanger pivot 1A.

Figure 6C:
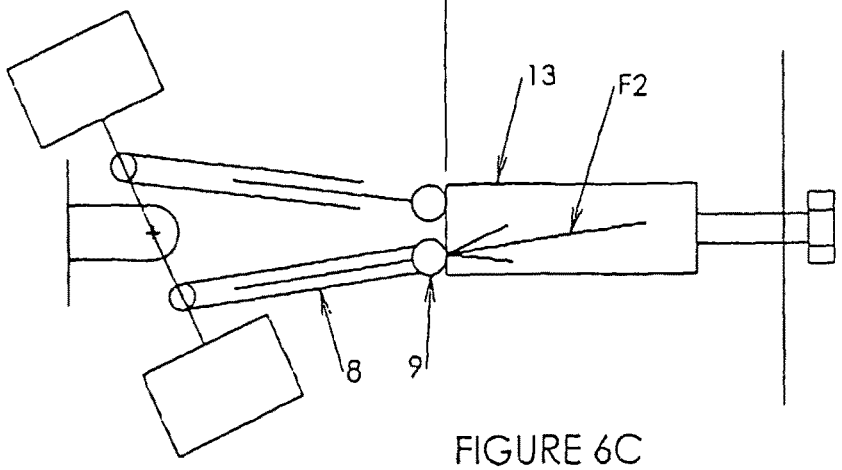

In FIG. 6C, the spring 13 compresses further as a result of in-use pivotal movement of the hanger 3 upon the hanger pivot 1A. In this configuration, one of the arms remaining fully retracted, transmitting 100% of the spring force F2, whereas the other arm extends and transmits that force.

The in-use dynamic characteristics of the skateboard truck can be adjusted by turning the preload bolt as desired or by substituting springs of differing spring rate.

It should be appreciated that modifications and alternations obvious to those skilled in the art are not to be considered as beyond the scope of the present invention. For example, the slider-in-guide arrangement might be replaced by a piston-in-sleeve arrangement. Furthermore, it should be noted that the concept as embodied in the described skateboard truck could be implemented in vehicles other than skateboards.

What is claimed is:

1. A truck comprising:

a base comprising a hanger pivot pin, and a longitudinal v-shaped guide, a transverse hanger mounted at its center to the hanger pivot pin and adapted to bear a road-engaging wheel at each opposed end thereof, a pair of telescopic arms, each telescopic arm comprising a hanger end portion and a slider end portion that is capable of telescoping within the hanger end portion, each slider end portion is connected to a slider by a ball joint, each hanger end portion pivotally attaches to the hanger and flanks the hanger pivot pin, the slider is fixed to a spring sleeve that houses a longitudinal spring and the slider is capable of sliding along the longitudinal v-shaped guide, a preload bolt passes through the longitudinal spring with one end attached to the base and it other end attached to a preload nut, wherein rotation of the preload bolt will compress the longitudinal spring.

2. The truck of claim 1 wherein the spring is a compression coil spring.

3. The truck of claim 2 wherein the spring sleeve is screw-fixed to the slider and locating the preload nut with which the preload bolt engages.

* * * * *